US007558496B2

(12) United States Patent
Watanabe

(10) Patent No.: US 7,558,496 B2
(45) Date of Patent: Jul. 7, 2009

(54) IMAGE FORMING DEVICE

(75) Inventor: Akihiro Watanabe, Nara (JP)

(73) Assignee: Kyocera Mita Corporation, Osaka (JP)

( * ) Notice: Subject to any disclaimer, the term of this patent is extended or adjusted under 35 U.S.C. 154(b) by 404 days.

(21) Appl. No.: 11/701,418

(22) Filed: Feb. 2, 2007

(65) Prior Publication Data

US 2007/0196116 A1 Aug. 23, 2007

(30) Foreign Application Priority Data

Feb. 20, 2006 (JP) ..... 2006-042909

(51) Int. Cl.
*G03G 15/10* (2006.01)
*G03G 15/08* (2006.01)

(52) U.S. Cl. ..... 399/62; 399/30; 399/58; 399/258

(58) Field of Classification Search ..... 399/27, 399/30, 53, 58, 61–63, 254, 258; 118/689, 118/690

See application file for complete search history.

(56) References Cited

U.S. PATENT DOCUMENTS

2002/0159781 A1* 10/2002 Hatori ..... 399/30
2003/0161643 A1* 8/2003 Uyama et al. ..... 399/27

FOREIGN PATENT DOCUMENTS

JP 10-186833 A 7/1998
JP 2001-354864 A 12/2001

* cited by examiner

*Primary Examiner*—Seungsook Ham
*Assistant Examiner*—Milton Gonzalez
(74) *Attorney, Agent, or Firm*—Global IP Counselors, LLP

(57) ABSTRACT

A developer agitation screw is provided with a blade to gather developer onto the sensor surface of a toner concentration sensor. A toner concentration control unit detects the maximum value of the output of the toner concentration sensor within each predetermined period of time, the predetermined period of time being longer than the period in which developer is gathered on the sensor surface of the toner concentration sensor by the blade. The obtained maximum value is used as a characteristic value to control the toner concentration.

16 Claims, 5 Drawing Sheets

IMAGE FORMING DEVICE

CROSS-REFERENCE TO RELATED APPLICATIONS

This application claims priority to Japanese Patent Application No. 2006-042909 filed on Feb. 20, 2006. The entire disclosure of Japanese Patent Application No. 2006-042909 is hereby incorporated herein by reference.

BACKGROUND OF THE INVENTION

1. Field of the Invention

The present invention generally relates to an image forming device. More specifically, the present invention relates to an image forming device such as a photocopier, printer, or the like.

2. Background Information

Normally in an image forming device, an electrostatic latent image is formed on a photosensitive drum, which is the image carrier. This electrostatic latent image is developed in a developing device to become a toner image. The toner image on the photosensitive drum is transferred onto a recording sheet. Then the toner image that is transferred onto the recording sheet is fixed onto the recording sheet by a fixing device.

Some developing devices use a two component developer that includes carrier and toner. In this type of developing device, when an image is being formed only toner is consumed, so the mixing ratio of toner and carrier varies. In order to obtain stable images, it is necessary to replenish the toner to maintain the mixing ratio of toner and carrier within a fixed range. Therefore in this type of developing device, the concentration of toner in the developer is measured with a magnetic sensor, and the toner is replenished based on the measured toner concentration.

Conventionally, the toner concentration is measured using the average value of sensor output voltage of a magnetic sensor as a characteristic value of sensor output as shown in Japanese Patent Application Laid-open No. H10-186833. Also, there are magnetic sensors that measure the minimum value in one period of the sensor output wave form as shown in Japanese Patent Application Laid-open No. 2001-354864. However, the method of measuring the toner concentration disclosed in Japanese Patent Application Laid-open No. 2001-354864 is valid only for developing devices having a special agitation member. The method is not valid for developing devices with the commonly-used screw-shaped agitation member.

In developing devices with the commonly used screw-shaped agitation member, the bulk density and consistency characteristics of the developer that is transported varies due to degradation with time and humidity and other environmental conditions. This also results in a change in the sensor output of the magnetic sensors. Also, when it is necessary to change the concentration of toner, the sensor output of the magnetic sensor also changes.

In these cases the shape of the sensor output wave form has the period of the agitation transport roller. However, when the sensor output is changed as referred to above, the sensor output wave form is not simply changed by shifting the output wave form, the minimum value of the sensor output wave form does not change, but the sensor output wave form is changed up to the maximum value. Therefore, using the average value of sensor output as the sensor characteristic output value to control the replenishment of toner does not achieve a stable toner concentration.

In view of the above, it will be apparent to those skilled in the art from this disclosure that there exists a need for an improved image forming device. This invention addresses this need in the art as well as other needs, which will become apparent to those skilled in the art from this disclosure.

SUMMARY OF THE INVENTION

It is an object of the present invention to provide an image forming device that is capable of obtaining a stable sensor output characteristic value from the sensor output of the toner concentration sensor, even when the characteristics of the developer are varied, or the toner concentration is varied.

An image forming device according to a first aspect of the present invention includes an image carrier, a developing device, a toner supply device, a toner concentration sensor, and a toner control unit. The developing device includes a developing roller that supplies toner to the image carrier and a developer agitation screw that agitates the developer and transports the developer to the developing roller. The developing device develops electrostatic latent images formed on the image carrier using developer that contains carrier and toner. The toner supply device supplies toner to the developing device. The toner concentration sensor measures the concentration of toner in the developing device. The toner concentration control unit controls the toner supply device based on the output of the toner concentration sensor. A blade is provided on the developer agitation screw to gather the developer onto the sensor surface of the toner concentration sensor. The toner concentration control unit detects the maximum value of the output of the toner concentration sensor within each predetermined period of time. The predetermined period of time is longer than the period in which developer is gathered on the sensor surface of the toner concentration sensor by the blade. The toner concentration control unit uses the obtained maximum value as a characteristic value to control the toner concentration.

An image forming device according to a second aspect of the present invention includes an image carrier, a developing device, a toner supply device, a toner concentration sensor, and a toner control unit. The developing device includes a developing roller that supplies toner to the image carrier and a developer agitation screw that agitates the developer and transports the developer to the developing roller. The developing device develops electrostatic latent images formed on the image carrier using developer that contains carrier and toner. The toner supply device supplies toner to the developing device. The toner concentration sensor measures the concentration of toner in the developing device. The toner concentration control unit controls the toner supply device based on the output of the toner concentration sensor. A blade is provided on the developer agitation screw to gather the developer onto the sensor surface of the toner concentration sensor. The toner concentration control unit detects the maximum value of the output of the toner concentration sensor within each predetermined period of time. The predetermined period of time is longer than the period in which developer is gathered on the sensor surface of the toner concentration sensor by the blade. The toner concentration control unit uses the average value or the moving average value of the maximum value obtained over a plurality of times as a characteristic value to control the toner concentration.

An image forming device according to a third aspect of the present invention includes an image carrier, a developing device, a toner supply device, a toner concentration sensor, and a toner control unit. The developing device includes a developing roller that supplies toner to the image carrier and a developer agitation screw that agitates the developer and transports the developer to the developing roller. The developing device develops electrostatic latent images formed on the image carrier using developer that contains carrier and toner. The toner supply device supplies toner to the developing device. The toner concentration sensor measures the concentration of toner in the developing device. The toner concentration control unit controls the toner supply device based on the output of the toner concentration sensor. A blade is provided on the developer agitation screw to gather the developer onto the sensor surface of the toner concentration sensor. The toner concentration control unit obtains a plurality of sensor output values that includes the maximum value and several sensor output values before and after the maximum value of the output of the toner concentration sensor in the predetermined period of time. The predetermined period of time is longer than the period in which developer is gathered on the sensor surface of the toner concentration sensor by the blade. The toner concentration control unit calculates the average value of the plurality of sensor output values, and controls the toner concentration using the average value as a characteristic value.

An image forming device according to a fourth aspect of the present invention includes an image carrier, a developing device, a toner supply device, a toner concentration sensor, and a toner control unit. The developing device includes a developing roller that supplies toner to the image carrier and a developer agitation screw that agitates the developer and transports the developer to the developing roller. The developing device develops electrostatic latent images formed on the image carrier using developer that contains carrier and toner. The toner supply device supplies toner to the developing device. The toner concentration sensor measures the concentration of toner in the developing device. The toner concentration control unit controls the toner supply device based on the output of the toner concentration sensor. A blade is provided on the developer agitation screw to gather the developer onto the sensor surface of the toner concentration sensor. The toner concentration control unit obtains a plurality of sensor output values that includes the maximum value and several sensor output values before and after the maximum value of the output of the toner concentration sensor in the predetermined period of time. The predetermined period of time is longer than the period in which developer is gathered on the sensor surface of the toner concentration sensor by the blade. The toner concentration control unit calculates the average value of the plurality of sensor output values, and controls the toner concentration using as a characteristic value the average value of the average values or the moving average value obtained over a plurality of periods of times.

According to the present invention it is possible to obtain a stable sensor output characteristic value from the sensor output of the toner concentration sensor, even when the characteristics of the developer are varied, or the toner concentration is varied.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

The following is an explanation of the embodiments of the present invention with reference to the drawings for the case of application to a photocopier.

Figure 1:
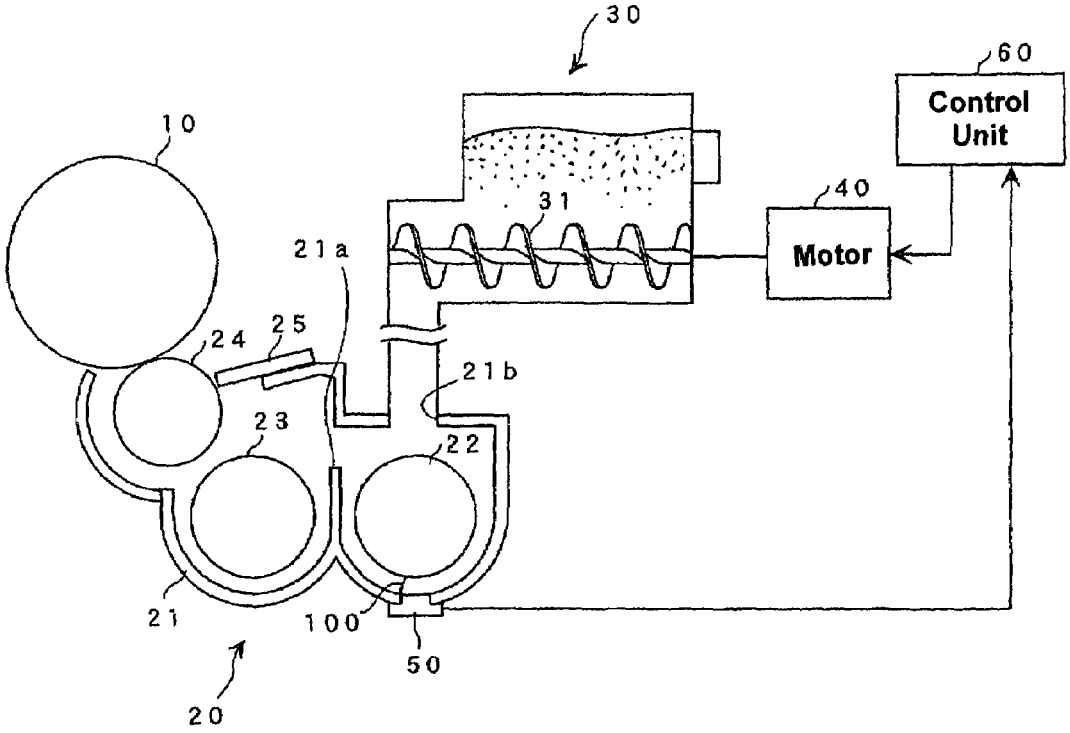
FIG. 1 is a view of a diagram of the configuration of a photosensitive drum and developing device within a photocopier in accordance with a preferred embodiment of the present invention.

FIG. 1 is a diagrammatical view showing a photosensitive drum and a developing device within a photocopier in accordance with a preferred embodiment of the present invention.

In FIG. 1, 10 is a photosensitive drum (image carrier), and 20 is a developing device that develops electrostatic latent images formed on the photosensitive drum 10 using toner.

Figure 2:
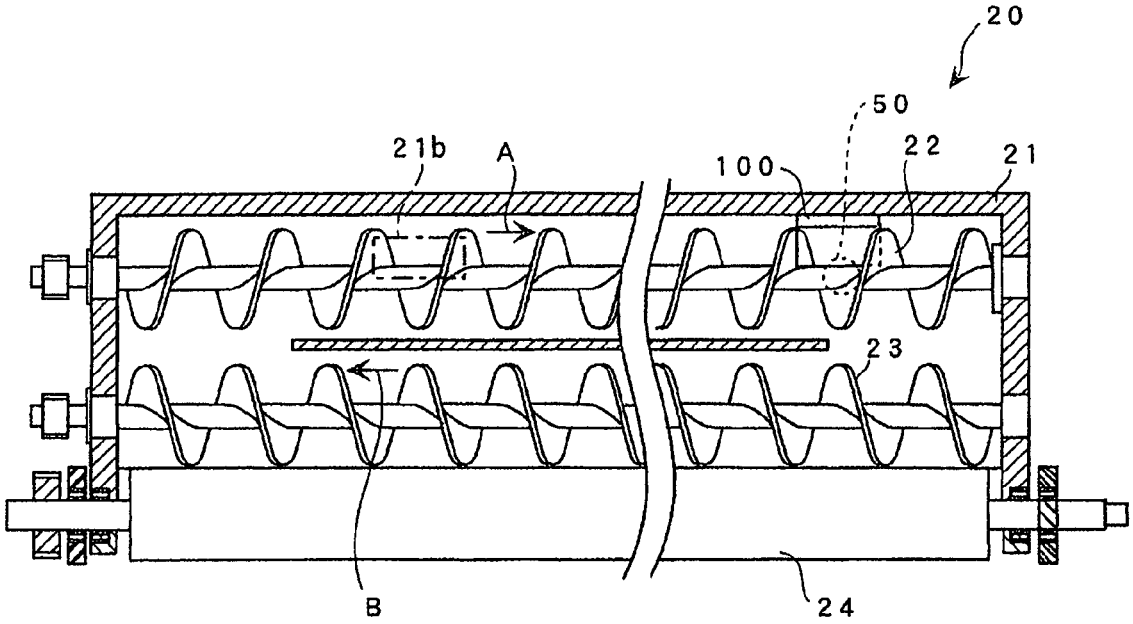
FIG. 2 is a cross-section view showing the developing device.

As shown in FIGS. 1 and 2, the developing device 20 includes a housing 21 that houses a two component developer that includes carrier and toner. Within the housing 21, a first agitation screw 22, a second agitation screw 23, and a developing roller 24 are disposed parallel to the photosensitive drum 10. In other words, their respective axes of rotation are parallel to one another. The developing roller 24 includes a developing sleeve and a magnetic roller within the developing sleeve. A partition wall 21*a* is provided between the first agitation screw 22 and the second agitation screw 23.

By rotating the first agitation screw 22 in a predetermined direction by a drive device that is not shown in the drawings, the developer is agitated and transported in the direction indicated by the arrow A in FIG. 2. By rotating the second agitation screw 23 in a predetermined direction by a drive device that is not shown in the drawings, the developer is agitated and transported in the direction indicated by the arrow B in FIG. 2, which is preferably opposite to the direction of the arrow A. The layer thickness of the developer that is transported to the developing roller 24 by the first agitation screw 22 and the second agitation screw 23 is regulated by a doctor blade 25 and supplied to the developing roller 24. Then the developer is supplied to the photosensitive drum 10 from the developing roller 24.

A toner supply aperture 21*b* is formed in the wall of the housing 21 of the developing device 20 above the first agitation screw 22. A toner supply device 30 is provided above the aperture 21*b*. Toner is housed within the toner supply device 30. Also, a toner replenishment screw 31 is provided within the toner supply device 30 to replenish the developing device 20 with toner. Thus, toner can be supplied to the developing device 20 in part by gravity. The toner replenishment screw 31 is rotated by a motor 40, so that toner within the toner supply device 30 is transported into the developing device 20.

A toner concentration sensor 50 that measures the toner concentration within the developing device 20 is provided at a predetermined location below the first agitation screw 22. A magnetic sensor may be used as the toner concentration sensor 50. The sensor output of the toner concentration sensor 50 is transmitted to a control unit (toner concentration control unit) 60. The control unit 60 measures the toner concentration within the developing device 20 based on the sensor output of the toner concentration sensor 50. If the measured toner concentration is lower than a threshold, the motor 40 is driven to supply toner from the toner supply device 30 to the developing device 20.

Figure 3A:
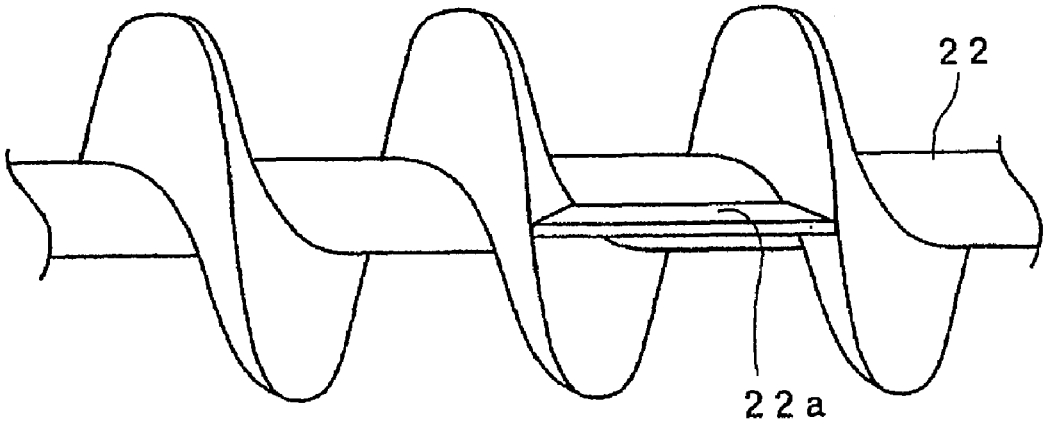
FIG. 3A is an isometric diagrammatical view provided to explain the installation structure of a blade in a first agitation screw of the developing device.
Figure 3B:
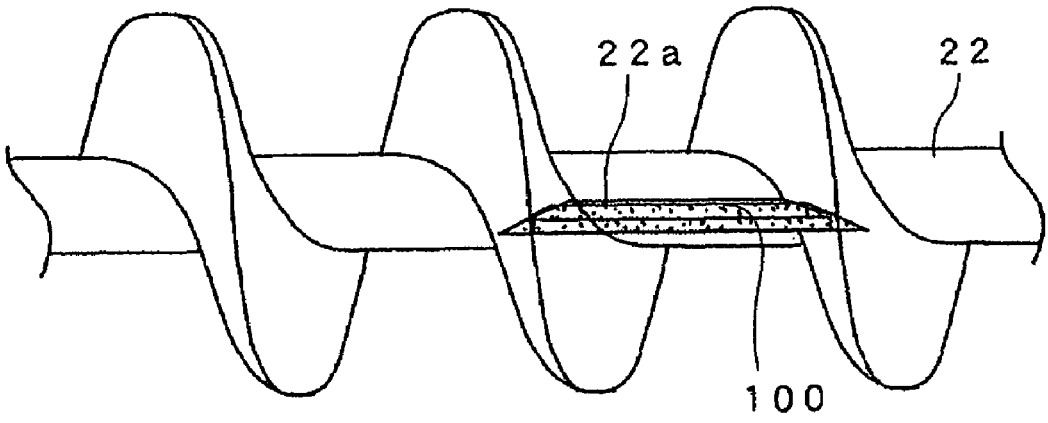
FIG. 3B is an isometric diagrammatical view provided to explain the installation structure of the blade in the first agitation screw.
Figure 4:
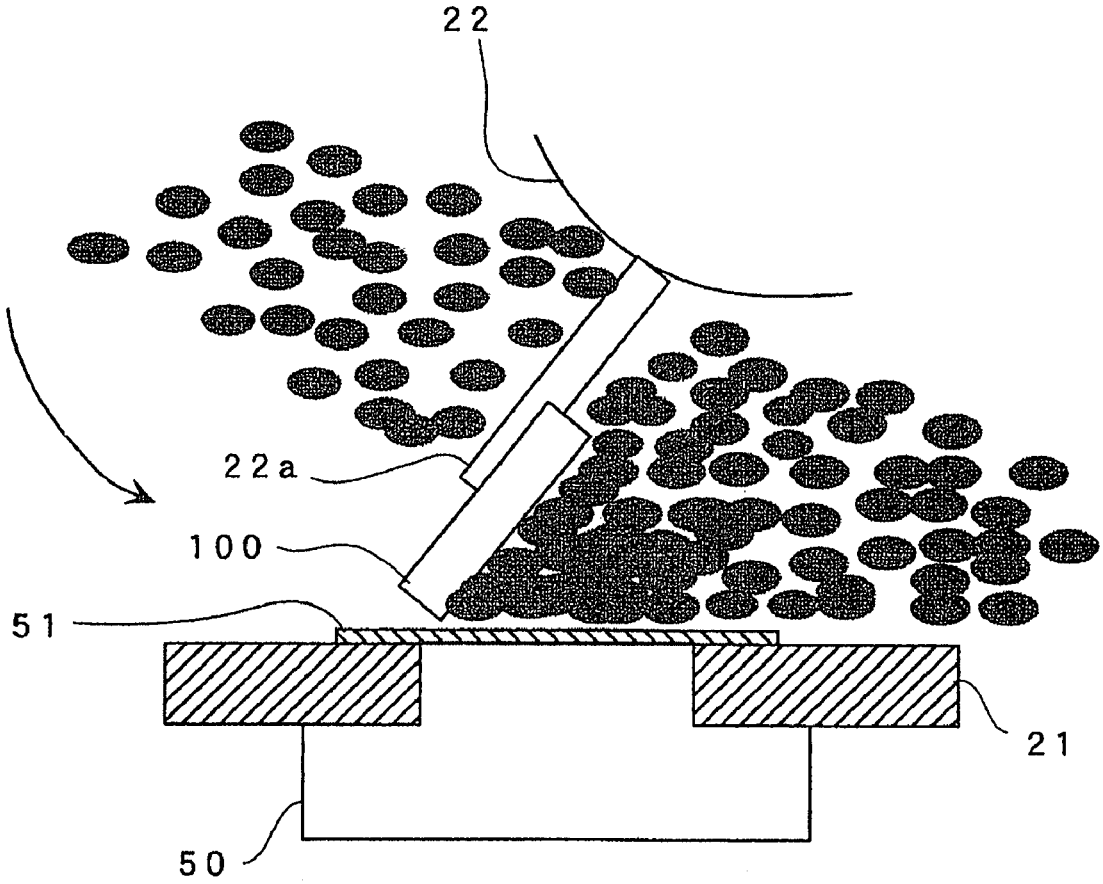
FIG. 4 is a schematic diagrammatical view showing developer concentrating on the sensor surface of a toner concentration sensor of the developing device due to the blade installed on the first agitation screw.

As shown in FIGS. 1 and 2, a blade 100 is installed on the first agitation screw 22 in a position corresponding to the toner concentration sensor 5 to gather the developer on the sensor surface of the toner concentration sensor 50. This type of blade 100 is installed on the first agitation screw 22 as follows. The first agitation screw 22 is made from a shaft and a blade formed in a spiral shape on the shaft. As shown in FIG. 3A, a plate shaped blade installation portion 22*a* is formed integrally on the first agitation screw 22 in a position corresponding to the toner concentration sensor 50 between adjacent blades (two blades separated by one pitch). Also, as shown in FIGS. 3B and 4, the rectangular shaped blade 100 is fixed to the blade installation portion 22*a*. One side of the blade 100 projects from the blade of the first agitation screw 22.

FIG. 4 shows a view of the developer gathered on the sensor surface of the toner concentration sensor 50 by the blade 100 installed on the first agitation screw 22. In FIG. 4, 51 is protective tape that protects the sensor surface of the toner concentration sensor 50.

The output voltage of the toner concentration sensor 50 becomes a larger value as the toner concentration becomes lower. As stated above, the blade 100 is installed on the first agitation screw 22 to gather developer on the sensor surface of the toner concentration sensor 50, so the sensor output wave form of the toner sensor 50 is as shown in FIG. 5, for example.

Figure 5:
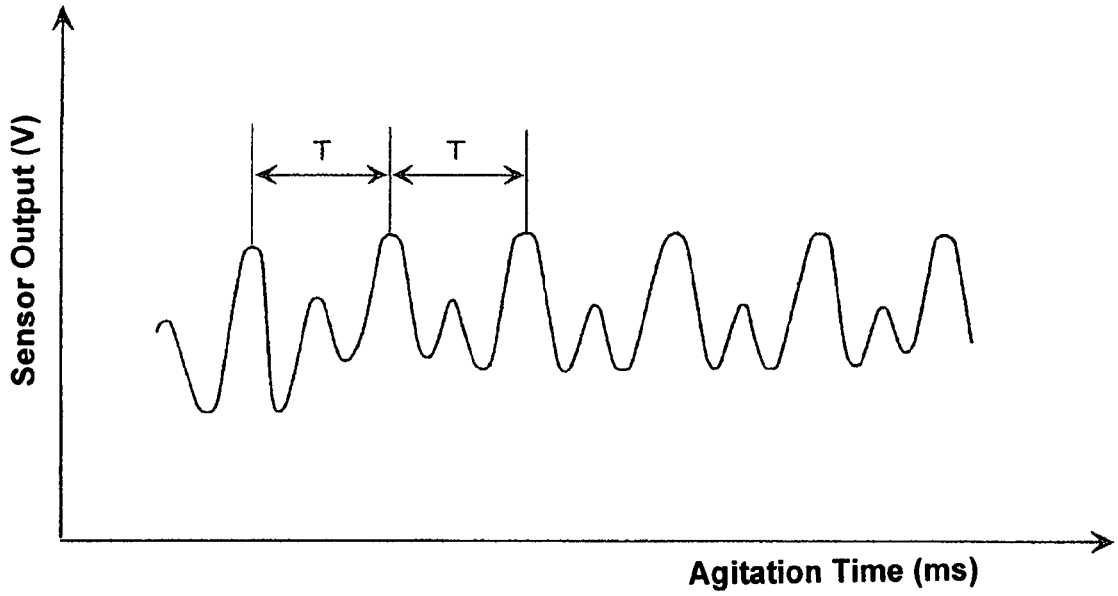
FIG. 5 is a diagrammatical view showing a wave form as an example of the output wave form of the toner concentration sensor.

Referring to FIGS. 1 and 5, the output voltage of the toner concentration sensor 50 increases at the time that developer is gathered onto the surface of the toner concentration sensor 50 by the blade 100. Also, at this time more developer is gathered onto the surface of the toner concentration sensor 50, so at this time the output voltage of the toner concentration sensor 50 accurately reflects the toner concentration.

The control unit 60 reads the output voltage of the toner concentration sensor 50 at time intervals that are very short with respect to the period T (corresponding to the time interval for one revolution of the agitation screw 22) in which the developer is gathered on the surface of the toner concentration sensor 50 by the blade 100. Also, the maximum value of the sensor output within each predetermined period of time Ta, which is longer than the period T in which the developer is gathered on the surface of the toner concentration sensor 50 by the blade 100, is detected. The obtained maximum value is used as a characteristic value to control the toner supply device 30. For example, the obtained maximum value is compared with a threshold value, and when the maximum value is larger than the threshold value the toner supply device 30 is driven to replenish the developing device 20 with toner. In this way, the characteristic value of the output voltage of the toner concentration sensor 50 at the time that the developer is gathered on the surface of the toner concentration sensor 50 by the blade 100 is used. Thus, the toner concentration can be accurately measured, and highly accurate toner replenishment control can be carried out. Ta is, for example, set to a time period corresponding to 1.2 T.

Also, the maximum value of the sensor output within the predetermined period Ta may be obtained for each predetermined time period Ta, and every time a predetermined number of maximum values have been obtained their average value may be calculated and used as the characteristic value. For example, if the characteristic value is obtained for every three maximum values, and if the three maximum values are M1, M2, and M3, then the characteristic value is (M1+M2+M3)/3.

Also, the maximum value of the sensor output within the predetermined period Ta may be obtained for each predetermined time period Ta, and a moving average of a predetermined number of maximum values may be used as the characteristic value. For example, in the case where the characteristic value is the moving average of three maximum values, and the maximum values are obtained successively as M1, M2, M3, M4, . . . , the characteristic values are obtained as (M1+M2+M3)/3, (M2+M3+M4)/3, . . . .

Also, the maximum value and several points before and after the maximum value (for example four points) of the sensor output within the predetermined period Ta may be obtained for each predetermined time period Ta, and the average value A of the several sensor output values calculated. The predetermined period Ta is longer than the period T in which the developer is gathered on the surface of the toner concentration sensor 50 by the blade 100. The average value A obtained may be used as the characteristic value to control the toner supply device 30.

Also, the average value A of several points in the vicinity of the maximum value in each predetermined period Ta as described above may be obtained, and every time a predetermined number of average values A is obtained, their average value may be calculated and used as the characteristic value. For example, in the case that a characteristic value is obtained every time that three average values A are obtained, and if the three average values are A1, A2, and A3, then the characteristic value is (A1+A2+A3)/3.

Also, the average value A of several points in the vicinity of the maximum value in each predetermined period Ta as described above may be obtained, and the moving average of a predetermined number of average values A may be used as the characteristic value. For example, in the case where the moving average of three average values A is the characteristic value, and if the average values are successively obtained as A1, A2, A3, and A4, . . . , then the characteristic values are obtained as (A1+A2+A3)/3, (A2+A3+A4)/3.

Terms that are expressed as "means-plus function" in the claims should include any structure that can be utilized to carry out the function of that part of the present invention.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers, and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of a image forming device equipped with the present invention. Accordingly, these terms, as utilized to describe the present invention should be interpreted relative to an image forming device equipped with the present invention as used in the normal riding position. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming device, comprising:

an image carrier;

a developing device being configured to develop electrostatic latent images formed on said image carrier using developer including carrier and toner, said developing device having a developing roller being configured to supply toner to said image carrier, and a first developer agitation screw being configured to agitate said developer and to transport said developer to said developing roller, said first developer agitation screw having a blade;

a toner supply device being configure to supply toner to said developing device;

a toner concentration sensor being configure to measure toner concentration within said developing device, said blade being configured to gather developer onto said concentration sensor at a first predetermined period of time; and a toner concentration control unit being configure to control said toner supply device based on the output of said toner concentration sensor, said toner concentration control unit being configured to detect a maximum value of said output of said toner concentration sensor during a second predetermined period of time being longer than said first predetermined period of time, and said toner concentration control unit being configured to control toner concentration using the obtained maximum value as a characteristic value.

2. The image forming device according to claim 1, wherein said developing device further has a second developer agitation screw being arranged between said first developer agitation screw and said developing roller.

3. The image forming device according to claim 2, wherein toner is supplied to said first developer agitation screw by gravity.

4. The image forming device according to claim 3, wherein said developing device is arranged below said toner supply device.

5. An image forming device, comprising:

an image carrier;

a developing device being configured to develop electrostatic latent images formed on said image carrier using developer including carrier and toner, said developing device having a developing roller being configured to supply toner to said image carrier, and a first developer agitation screw being configured to agitate said developer and to transport said developer to said developing roller, said first developer agitation screw having a blade;

a toner supply device being configured to supply toner to said developing device;

a toner concentration sensor being configured to measure toner concentration within said developing device, said blade being configured to gather developer onto said concentration sensor at a first predetermined period of time; and a toner concentration control unit being configured to control said toner supply device based on the output of said toner concentration sensor, said toner concentration control unit being configured to detect a maximum value of the output of said toner concentration sensor during a second predetermined period of time being longer than said first predetermined period of time, and said toner concentration control unit being configured to control toner concentration using the average value or the moving average value of the maximum values obtained during a plurality of periods of time as a characteristic value.

6. The image forming device according to claim 5, wherein said developing device further has a second developer agitation screw being arranged between said first developer agitation screw and said developing roller.

7. The image forming device according to claim 6, wherein toner is supplied to said first developer agitation screw by gravity.

8. The image forming device according to claim 7, wherein said developing device is arranged below said toner supply device.

9. An image forming device, comprising:

an image carrier;

a developing device being configured to develop electrostatic latent images formed on said image carrier using developer including carrier and toner, said developing device having a developing roller being configured to supply toner to said image carrier, and a first developer agitation screw being configured to agitate said developer and to transport said developer to said developing roller, said first developer agitation screw having a blade;

a toner supply device being configured to supply toner to said developing device;

a toner concentration sensor being configured to measure toner concentration within said developing device, said blade being configured to gather developer onto said concentration sensor at a first predetermined period of time; and a toner concentration control unit being configured to control said toner supply device based on the output of said toner concentration sensor, said toner concentration control unit being configured to detect the maximum value and several sensor output values before and after the maximum value of the output of said toner concentration sensor during a second predetermined period of time being longer than said first predetermined period of time, and said toner concentration control unit being configured to calculate the average value of the plurality of sensor output values, and to control toner concentration using the obtained average value as a characteristic value.

10. The image forming device according to claim 9, wherein said developing device further has a second developer agitation screw being arranged between said first developer agitation screw and said developing roller.

11. The image forming device according to claim 10, wherein toner is supplied to said first developer agitation screw by gravity.

12. The image forming device according to claim 11, wherein said developing device is arranged below said toner supply device.

13. An image forming device, comprising:

an image carrier;

a developing device being configured to develop electrostatic latent images formed on said image carrier using developer including carrier and toner, said developing device having a developing roller being configured to supply toner to said image carrier, and a first developer agitation screw being configured to agitate said developer and to transport said developer to said developing roller, said first developer agitation screw having a blade;

a toner supply device being configured to supply toner to said developing device;

a toner concentration sensor being configured to measure toner concentration within said developing device, said blade being configured to gather developer onto said concentration sensor at a first predetermined period of time; and a toner concentration control unit being configured to control said toner supply device based on the output of said toner concentration sensor, said toner concentration control unit being configured to detect the maximum value and several sensor output values before and after the maximum value of the output of said toner concentration sensor during a second predetermined period of time being longer than said first predetermined period of time, to calculate the average value of the plurality of sensor output values, and to control toner concentration using the average value or moving average value of the average values obtained a plurality of times as a characteristic value.

14. The image forming device according to claim 13, wherein said developing device further has a second developer agitation screw being arranged between said first developer agitation screw and said developing roller.

15. The image forming device according to claim 14, wherein toner is supplied to said first developer agitation screw by gravity.

16. The image forming device according to claim 15, wherein said developing device is arranged below said toner supply device.

* * * * *